US007532830B2

(12) United States Patent
Kumar et al.

(10) Patent No.: US 7,532,830 B2
(45) Date of Patent: May 12, 2009

(54) ENVIRONMENTAL CONTROLS FOR OPERATION OF AN ELECTROSTATOGRAPHIC DEVELOPER UNIT HAVING MULTIPLE MAGNETIC BRUSH ROLLS

(75) Inventors: Ajay Kumar, Fairport, NY (US); Hirotsugu Oba, Webster, NY (US); Keith Allan Nau, Webster, NY (US); David Antwone Reed, Rochester, NY (US); Cory Joseph Winters, Rochester, NY (US); Michael Donald Thompson, Rochester, NY (US); Allen T. Retzlaff, Rochester, NY (US); Jennifer Rea Wagner, Ontario, NY (US); Paul W. Morehouse, Jr., Webster, NY (US); Rasin Moser, Fairport, NY (US); Song Feng Mo, Webster, NY (US); Rachael L. McGrath, Churchville, NY (US); John Franklyn Knapp, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 423 days.

(21) Appl. No.: 11/496,646

(22) Filed: Jul. 31, 2006

(65) Prior Publication Data

US 2008/0025739 A1 Jan. 31, 2008

(51) Int. Cl.
*G03G 15/09* (2006.01)

(52) U.S. Cl. ..... 399/44; 399/55; 399/269; 399/270

(58) Field of Classification Search ..... 399/44, 399/55, 269, 270
See application file for complete search history.

(56) References Cited

U.S. PATENT DOCUMENTS

| | | | | |
|---|---|---|---|---|
| 4,314,755 | A * | 2/1982 | Kinashi | 399/44 |
| 4,395,112 | A * | 7/1983 | Miyakawa et al. | 399/44 |
| 4,521,103 | A * | 6/1985 | Ohtsuka et al. | 399/44 |
| 5,183,964 | A * | 2/1993 | Stelter et al. | 399/44 |
| 6,463,226 | B2 | 10/2002 | Kitajima et al. | |
| 6,859,628 | B2 | 2/2005 | Kobashigawa | |
| 6,985,675 | B2 | 1/2006 | Guddanti et al. | |

* cited by examiner

*Primary Examiner*—William J Royer
(74) *Attorney, Agent, or Firm*—Maginot, Moore & Beck LLP

(57) ABSTRACT

A development station that improves toner halftone dot development over a wide range of environmental conditions includes a developer housing for retaining semi-conductive carrier particles and toner particles, a first magnetic roll having a stationary core with at least one magnet and a sleeve having longitudinal grooves that rotates about the stationary core of the first magnetic roll, a second magnetic roll having a stationary core with at least one magnet and a sleeve having longitudinal grooves that rotates about the stationary core of the second magnetic roll, an environmental sensor for generating an environmental condition signal, a variable voltage supply coupled to the first magnetic roll and the second magnetic roll, and a control circuit for adjusting an output level for the variable voltage supply.

19 Claims, 6 Drawing Sheets

ENVIRONMENTAL CONTROLS FOR OPERATION OF AN ELECTROSTATOGRAPHIC DEVELOPER UNIT HAVING MULTIPLE MAGNETIC BRUSH ROLLS

CROSS-REFERENCE TO RELATED APPLICATIONS

Reference is made to commonly-assigned U.S. patent application Ser. No. 11/262,575, entitled "Xerographic Developer Unit Having Multiple Magnetic Brush Rolls Rotating Against The Photoreceptor," which was filed on Oct. 31, 2005; U.S. patent application Ser. No. 11/262,577 entitled "Xerographic Developer Unit Having Multiple Magnetic Brush Rolls With A Grooved Surface," which was filed on Oct. 31, 2005; U.S. patent application Ser. No. 11/262,576 entitled "Xerographic Developer Unit Having Multiple Magnetic Brush Rolls Rotating With The Photoreceptor," which was filed on Oct. 31, 2005; U.S. patent application Ser. No. 11/263,370 entitled "Variable Pitch Auger To Improve Pickup Latitude In Developer Housing", which was filed on Oct. 31, 2005, and U.S. patent application Ser. No. 11/263,371 entitled "Developer Housing Design With Improved Sump Mass Variation Latitude," which was filed on Oct. 31, 2005, the disclosures of which are incorporated herein.

TECHNICAL FIELD

The present disclosure relates generally to an electrostatographic or xerographic printing machine, and more particularly concerns a development subsystem having multiple developer rolls that delivers semi-conductive developer to a photoreceptor.

BACKGROUND

In the process of electrophotographic printing, a charge-retentive or photoconductive surface, also known as a photoreceptor, is charged to a substantially uniform potential, so as to sensitize the surface of the photoreceptor. The charged portion of the photoconductive surface is exposed to a light image of an original document being reproduced, or else to a scanned laser image that is generated by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the latent image. This developed or toner image on the photoreceptor is subsequently transferred to a sheet on which the desired image is to be printed. Finally, the toner on the sheet is heated to permanently fuse the toner image to the sheet.

One familiar type of development of an electrostatic image is called "two-component development." Two-component developer material largely comprises toner particles interspersed with carrier particles. The carrier particles may be attracted magnetically and the toner particles adhere to the carrier particles through triboelectric forces. This two-component developer can be conveyed, by means such as a "magnetic roll," to the electrostatic latent image, where toner particles become detached from the carrier particles and adhere to the electrostatic latent image.

In magnetic roll development systems, the carrier particles with the triboelectrically adhered toner particles are transported by the magnetic rolls through a development zone. The development zone is the area between the outside of a magnetic roll and the photoreceptor surface on which a latent image has been formed. Because the carrier particles are attracted to the magnetic roll, some of the toner particles are interposed between a carrier particle and the latent image on the photoreceptor. These toner particles are attracted to the latent image and transfer from the carrier particles to the latent image. The carrier particles are removed from the development zone as they continue to follow the rotating surface of the magnetic roll. The carrier particles then fall from the magnetic roll and return to the developer supply where they attract more toner particles and are reused in the development process. The carrier particles fall from the magnetic roll under the effects of gravity or are directed away from the roll surface by a magnetic field.

One type of carrier particle used in two-component developers is the semi-conductive carrier particle. Developers using this type of carrier particle are also capable of being used in magnetic roll systems that produce toner bearing substrates at speeds of up to approximately 200 pages per minute (ppm). Developers having semi-conductive carrier particles use a relatively thin layer of developer on the magnetic roll in the development zone. In these systems an AC electric waveform is applied to the magnetic roll to cause the developer to become electrically conductive during the development process. The electrically conductive developer increases the efficiency of development by preventing development field collapse due to countercharge left in the magnetic brush by the developed toner. A typical waveform applied to these systems is, for example, a square wave at a peak to peak amplitude of 1000 Volts and a frequency of 9 KHz. This waveform controls both the toner movement and the electric fields in the development zone. These systems may be run in a "with" mode, which means the magnetic roll surface runs in the same direction as the photoreceptor, or in an "against" mode, which means the magnetic roll runs in a direction that is the opposite direction in which the photoreceptor runs.

One embodiment of a two magnetic roll development station increases the time for developing the toner and provides an adequate supply of developer for good line detail, edges, and solids. The embodiment includes an upper magnetic developer roll and a lower magnetic developer roll with both developer rolls having a stationary core with at least one magnet and a sleeve that rotates about the stationary core. A motor coupled to the two magnetic developer rolls drives the rotating sleeves of the magnetic developer rolls in a direction that is against the rotational direction of a photoreceptor to which the two magnetic rolls deliver toner. The two magnetic developer rolls carry semi-conductive carrier particles and toner particles through a development zone formed by the magnetic developer rolls. A trim blade is mounted proximate the upper magnetic developer roll to form a trim gap of approximately 0.5 to approximately 0.75 mm.

This development station architecture has generally resulted in improved development for electrostatographic imaging machines. The two magnetic rollers arranged in the vertical architecture enable development of higher resolution images comprised of smaller toner dots on the photoreceptor. As the toner dots become smaller, the ratio of dot perimeter to the dot surface area becomes larger and variations in toner development for the dots become more apparent. At the toner dot sizes made possible by the vertical architecture noted above, toner development is adversely impacted by environmental conditions, particularly humidity. This adverse impact appears to arise from fluctuations in the electric fields generated by the AC waveform at the edge of the dots being developed on the photoreceptor. These fluctuations may result in dot formation variation that produces grainy half-tone images.

Known techniques for adjusting development station operations to compensate for changes in environmental conditions are not effective for adjusting the operation of the vertical roller architecture that is used for development of two component developer as discussed above. Attempts to scale these known operational parameters for use with the two vertical roller architecture described above have been frustrated with inconsistent results.

The development station and method discussed below improve toner dot edge development and stabilize toner dot size in a variety of environmental conditions.

SUMMARY

A development station in an electrostatographic imaging machine may be controlled to improve toner dot development over a wide range of environmental conditions. The development station includes a developer housing for retaining a quantity of developer having semi-conductive carrier particles and toner particles, a first magnetic roll having a stationary core with at least one magnet and a sleeve having longitudinal grooves that rotates about the stationary core of the first magnetic roll to present developer on one side of the first magnetic roll to a photoreceptor, a second magnetic roll having a stationary core with at least one magnet and a sleeve having longitudinal grooves that rotates about the stationary core of the second magnetic roll to receive developer from the first magnetic roll and present developer on one side of the second magnetic roll to the photoreceptor, the second magnetic roll being vertically displaced from the first magnetic roll so that a gap exists between the first and the second magnetic rolls, an environmental sensor for generating an environmental condition signal, a variable voltage supply coupled to the first magnetic roll and the second magnetic roll, and a control circuit for adjusting an output level for the variable voltage supply in response to the environmental condition signal.

The development station may implement a method for improving toner dot development. The method includes sensing an environmental condition, reducing electric field fluctuation in a development gap between a magnetic roller in a development station and a photoreceptor, and reducing sensitivity of the development station to electric field fluctuation. The electric field fluctuation may be reduced by adjusting a peak-to-peak voltage coupled to magnetic rollers in a development station in response to the sensing of an environmental condition that affects toner development, while the electric field fluctuation sensitivity may be reduced by lowering a cleaning voltage for the development station.

DETAILED DESCRIPTION

Figure 1:
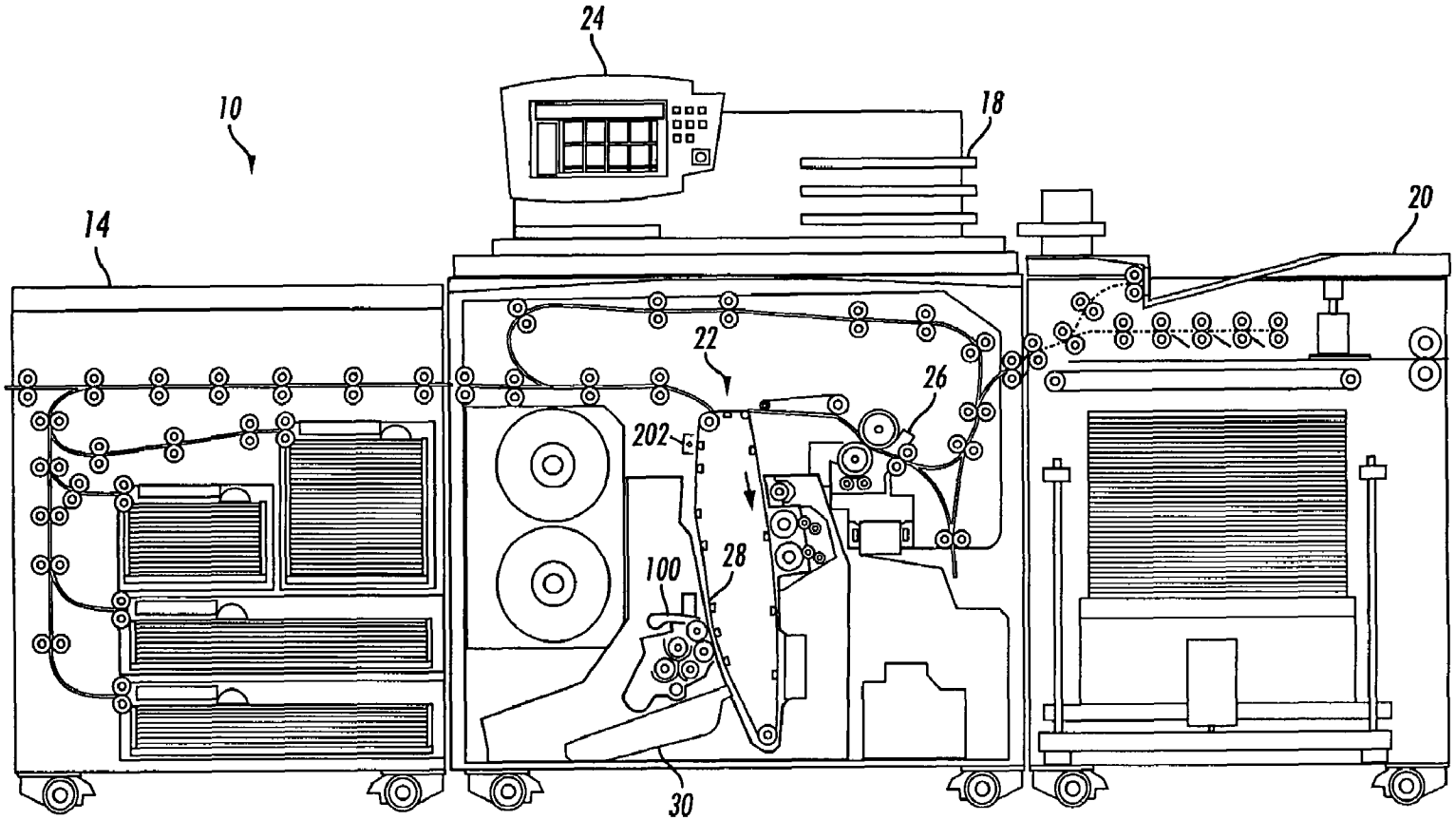
FIG. 1 is an elevational view of an electrostatographic imaging machine incorporating a semi-conductive magnetic brush development (SCMB) system that adjusts operational parameters for improving toner dot development.

FIG. 1 is an elevational view of an electrostatographic imaging machine 10, such as a printer or copier, having a development subsystem that improves toner halftone dot development. The machine 10 includes a feeder unit 14, a printing unit 18, and an output unit 20. The feeder unit 14 houses supplies of media sheets and substrates onto which document images are transferred by the printing unit 18. Sheets to which images have been fixed are delivered to the output unit 20 for correlating and/or stacking in trays for pickup.

The printing unit 18 includes an operator console 24 where job tickets may be reviewed and/or modified for print jobs performed by the machine 10. The pages to be printed during a print job may be scanned by the machine 10 or received over an electrical communication link. The page images are used to generate bit data that are provided to a raster output scanner (ROS) 30 for forming a latent image on a photoreceptor 28. Photoreceptor 28 continuously travels the circuit depicted in the figure in the direction indicated by the arrow. A development station 100 develops toner on the photoreceptor 28. At a transfer station 22, the toner conforming to the latent image is transferred to the substrate by electric fields generated by the transfer station 22. The substrate bearing a toner image travels to a fuser station 26 where the toner image is fixed to the substrate. The substrate is then carried to the output unit 20. This description is provided to generally describe the environment in which a double magnetic roll development system for developer having semi-conductive carrier particles may be used and is not intended to limit the use of such a development subsystem 100 to this particular printing machine environment.

Figure 2:
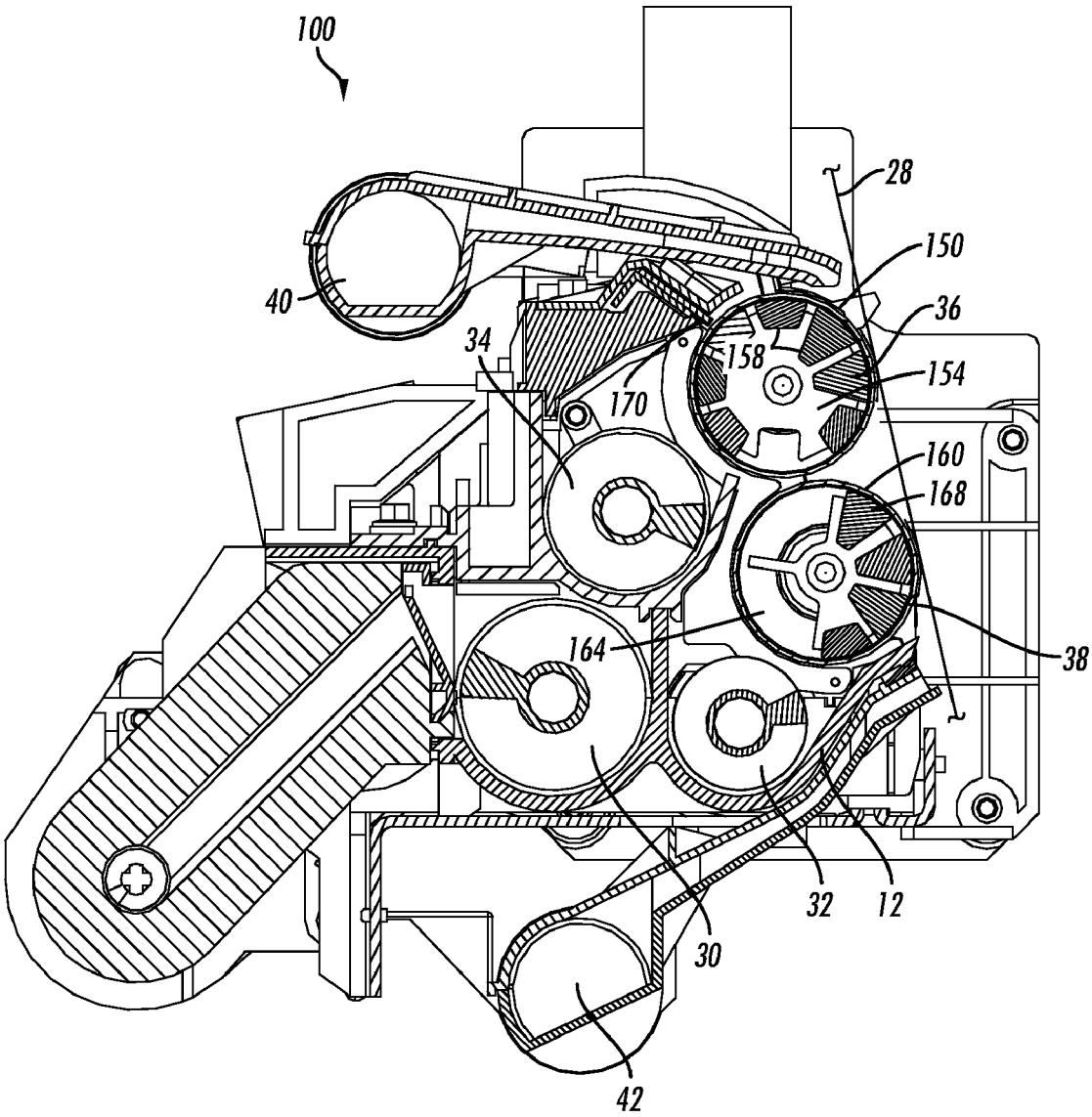
FIG. 2 is a sectional view of a SCMB developer unit shown in FIG. 1.

The overall function of development station 100, which is shown in FIG. 2, is to apply marking material, such as toner, onto suitably-charged areas forming a latent image on an image receptor such as the photoreceptor 28, in a manner generally known in the art. The operation of the development station 100 may be altered by the control circuit 200 (FIG. 3) to improve toner dot development in adverse environmental conditions. In various types of printers, multiple development stations 100 of this construction may be used. For example, one such station may be used for each primary color or other purpose.

Among the elements of the development station 100, which is shown in FIG. 2, are a housing 12, which functions generally to hold a supply of developer material having semi-conductive carrier particles, as well as augers, such as 30, 32, 34, which variously mix and convey the developer material to magnetic rolls 36, 38. In the embodiment depicted here, developer material from the augers 30, 32, 34 is attracted to the magnetic rolls 36, 38 to form magnetic brushes for applying toner to the photoreceptor 28. Other types of features for development of latent images, such as donor rolls, paddles, scavengeless-development electrodes, commutators, etc., are known in the art and may be used in conjunction with various embodiments pursuant to the claims. In the illustrated embodiment, air manifolds 40, 42, are attached to vacuum sources (not shown) for removing dirt and excess particles from the area near photoreceptor 28. The augers 30, 32, and 34 are configured and cooperate in a manner described in co-pending applications entitled "Variable Pitch Auger To Improve Pickup Latitude In Developer Housing," which was filed on Oct. 31, 2005 and assigned Ser. No. 11/263,370, and "Developer Housing Design With Improved Sump Mass Variation Latitude," which was also filed on Oct. 31, 2005 and assigned Ser. No. 11/263,371, both of which are hereby expressly incorporated herein in their entireties by reference and are commonly assigned to the assignee of this patent application.

As can be seen in this embodiment, the upper magnetic roll 36 and the lower magnetic roll 38 form a development zone that is approximately as long as the two diameters of the magnetic rolls 36 and 38. A motor, not shown, is coupled to the magnetic rolls 36 and 38 to cause rotation of the various augers, 30, 32, 34, magnetic rolls 36, 38, and any other rotatable members within the development station 100 at various relative velocities. There may be provided any number of such motors. The magnetic rolls 36 and 38 may be rotated in a direction that is opposite to the direction in which the photoreceptor 28 moves past the development station 100. That is, the two magnetic rolls 36, 38 are operated in the against mode for development of toner, although the magnetic rolls 36, 38 may also be operated in the with mode as well. In one embodiment of the development station 100, the motor rotates the magnetic rolls 36, 38 at a speed in the range of about 1 to about 1.5 times the rotational speed of the photoreceptor 28. This rotational speed is lower than the rotational speed of magnetic rolls in development systems that rotate in the same direction as the photoreceptor 28. That is, the magnetic rolls 36, 38 operated in the against mode may be rotated at lower speeds than magnetic rolls operated in the with mode. These slower speeds increase the life of the magnetic rolls36, 38 over the life of magnetic rolls that are operated in the with mode to develop toner carried on semiconductive carrier particles.

As may be observed from FIG. 2, the upper magnetic roll 36 includes a sleeve 150 that is mounted about a stationary core 154 that has at least one magnet 158. Likewise, the lower magnetic roll 38 includes a sleeve 160 that is mounted about a stationary core 164 that has at least one magnet 168. Longitudinal grooves are provided in the surface of the sleeves 150, 160 to impede slippage of developer on the rotating sleeves 150, 160. A trim blade 170 is mounted in proximity to upper magnetic roll 36 to remove excess developer from the magnetic roll 36 before it is carried into the development zone formed by magnetic rolls 36 and 38.

The development of toner by the development station 100 is discussed in more detail with reference to FIG. 3. The augers 30, 32, and 34 mix the carrier particles and toner particles together and triboelectrically charge the toner particles. This charge attracts the toner particles to the carrier particles. At a position between the auger 34 and the magnetic roll 36, the developer is attracted by the magnets in the magnetic roll 36. The attracted developer is carried by the magnetic roll 36 to the trim blade 170 where excess developer is removed from the roll 36 and returned to the auger 34.

Figure 4:
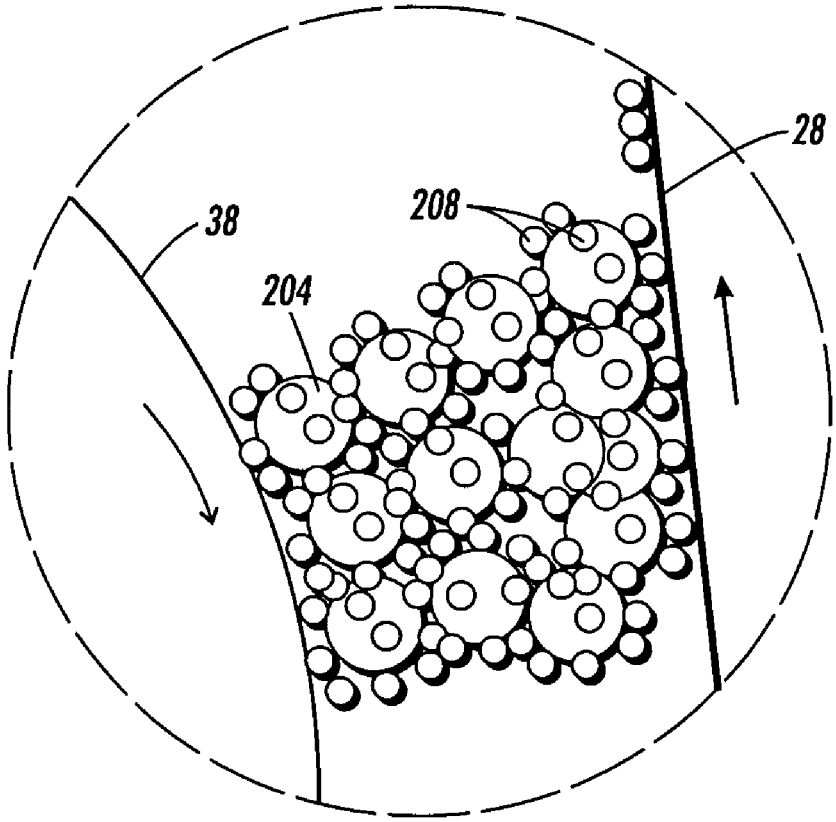
FIG. 4 depicts transfer of toner particles from a magnetic roll of the developer unit in FIG. 3 to a photoreceptor.

The layer remaining after the trim blade 170 is transported by the magnetic roll 36 to a position where the developer on the magnetic roll 36 is between the magnetic roll 36 and the photoreceptor 28. Some of the toner particles are attracted to latent image areas on the photoreceptor 28. The carrier and toner particles remaining on the magnetic roll 36 continue to be transported by the magnetic roll 36 until they are transferred to the magnetic roll 38. As shown in FIG. 4, this developer is carried to a position where the developer is between the magnetic roll 38 and the photoreceptor 28 as carrier particles 204 transport multiple toner particles 208 about their perimeters. The electrically charged toner particles 208 proximate the photoreceptor 28 are attracted to the latent image and some of them migrate to the photoreceptor 28. The carrier and toner particles 204, 208 that remain on the magnetic roll 38 are transported to a position where they fall from the magnetic roll 38 and return to the developer supply in housing 12.

In previously known development stations, a square wave having a peak-to-peak amplitude of approximately 1000 volts and a frequency of 9 KHz was applied to the magnetic rolls. This waveform increased the efficiency of development by preventing development field collapse caused by countercharge left in the magnetic brush by the developed toner. This waveform controls both the toner movement and the electric fields in the development zone. In the vertical architecture shown in FIG. 2, however, changing environmental conditions caused image degradation. Previously known systems, such as the one disclosed in U.S. Pat. No. 6,859,628 to Kobashigawa, adjusted the development contrast potential to address image degradation occurring during changing environmental conditions. Such an approach, however, is not effective in the development architecture that uses two magnetic rolls that are vertically arranged.

Figure 3:
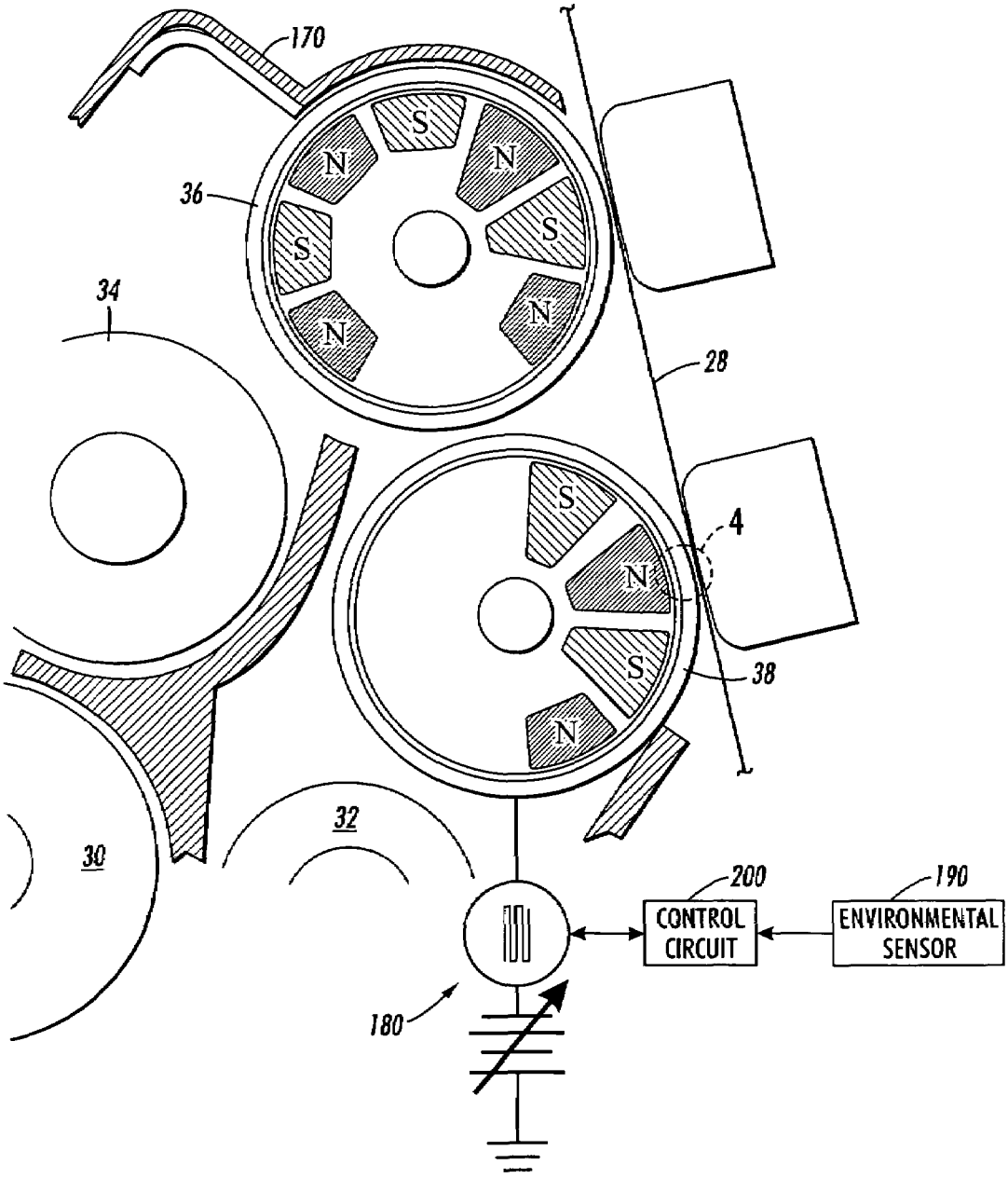
FIG. 3 is a side view of a SCMB developer unit shown in FIG. 2 and the coupling of the variable voltage supply with a control circuit and environmental sensor.

In the development station 100 shown in FIG. 3, the control circuit 200 generates a reference voltage signal in response to an environmental condition signal. The reference voltage signal adjusts the output level of the variable voltage supply 180 that is coupled to the magnetic rolls 36 and 38. The adjustment of the output level of the variable voltage supply 180 helps stabilize the toner dot development at the photoreceptor 28. Specifically, the adjustment helps reduce electric field fluctuations at the surface of the photoreceptor 28 in the vicinity of the magnetic rolls 36 and 38. Additionally, a development cleaning field voltage may be regulated at previously unknown levels to help reduce sensitivity of the development station 100 to electric field fluctuations in the development gap 4 between the magnetic rolls 36, 38 and the photoreceptor 28. The control circuit 200 may also maintain the frequency of the variable voltage supply 180 output at a frequency of approximately 12 KHz and the duty cycle of the output waveform in a range of approximately 65% to approximately 75%.

A pre-transfer corotron 202 (FIG. 1) provides a pre-transfer discharge to the photoreceptor 28 for the purpose of adjusting the tackiness of the toner on the photoreceptor 28. The control circuit 200 may also include a pre-transfer signal generator for generating a pre-transfer signal to operate a pre-transfer corotron with a current of about 17 μA to about 32 μA as well as a transfer signal generator for generating a transfer signal to operate a transfer corotron with a current of about 78 μA to about 88 μA. These current levels in conjunction with the other development housing parameters disclosed herein stabilize final toner image on paper across a wide range of environmental conditions.

The control circuit 200 may be comprised of a microprocessor or microcontroller with supporting memory, input/output (I/O) interfaces, and communication busses. The memory may contain stored instructions for the processor or controller to evaluate an environmental condition signal received from the environmental sensor 190 and to generate the reference voltage signal for setting the output level of the variable voltage supply 180. The control circuit 200 may alternatively be comprised of hardwired logic circuits to perform these functions. In another embodiment, the control circuit 200 may be implemented with an application specific integrated chip (ASIC). The ASIC implementation may also include the environmental sensor 190 and the variable voltage supply 180.

The environmental sensor 190 may include one or more sensors for generating one or more environmental signals. For example, the environmental sensor 190 may include a thermistor that changes its resistance in response to temperature fluctuations. Monitoring the voltage across a thermistor provides the control circuit 200 with a signal indicative of a continuous range of temperature for the development station 100 environment. Temperature thresholds may be determined empirically to identify temperatures at which control signals may be generated for modifying or adjusting operational parameters for the development station 100. Other known methods and devices for monitoring temperature may also be used. The environmental sensor 190 may include a relative humidity sensor. Such a device provides the control circuit 200 with a signal indicative of the water saturation level in the air about the development station 100.

Figure 5:
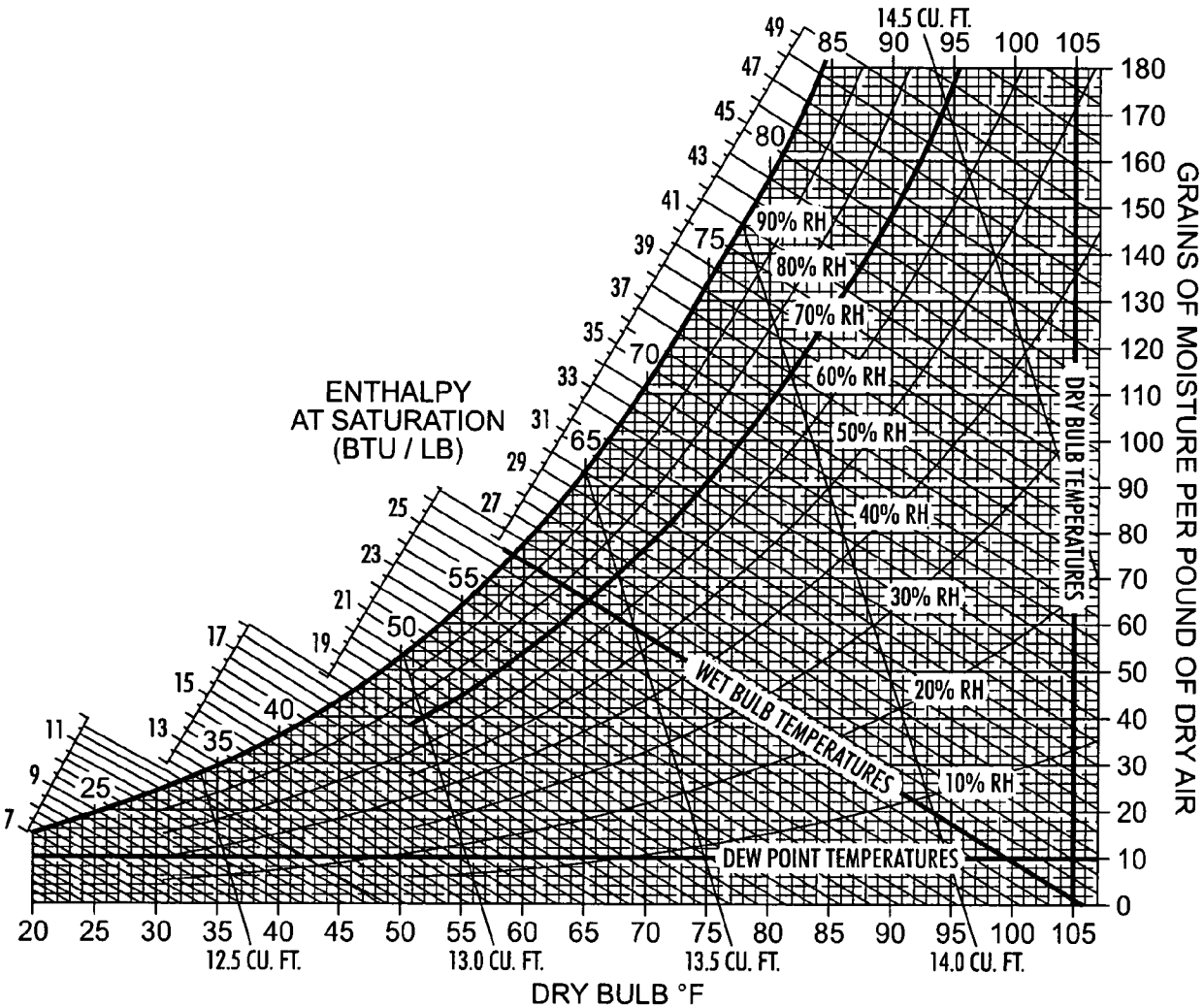
FIG. 5 is a psychrometric chart depicting data used to determine a grain of moisture measurement for the developer unit environment.

The control circuit 200 uses the signal(s) from the environmental sensor 190 for temperature and relative humidity and converts these measurements to grains of water. The grains of moisture (GOM) per pound of dry air may be determined using a psychrometric chart in combination with the measurements obtained from the environmental sensors 190 and altitude data stored in non-volatile memory. A psychrometric chart describes the possible combinations of temperature, moisture content, density and heat content properties of air for a range of values for these parameters. A psychrometric chart used in one embodiment is shown in FIG. 5. A function is programmed in the instructions executed by the control circuit 200 that conforms to the data depicted in the psychrometric chart. The measured temperature and relative humidity readings are input to the function and the corresponding grains of moisture value is returned. Thus, the control circuit 200 is able to correlate environmental conditions at the development station 100 to a GOM reading. Empirically determined GOM measurements may be identified as thresholds for adjusting the operational parameters of the development station 100. For example, detecting a GOM of 125 results in the AC peak-to-peak voltage being set to a level of 800V.

The control circuit 200 uses the signal(s) from the environmental sensor 190 to classify the environmental conditions about the development station 100. In response to this evaluation of the environmental conditions, the control circuit 200 generates a signal for adjusting the variable voltage supply 180 coupled to the magnetic rolls 36 and 38. In previously known development stations, the voltage coupled to the magnetic rolls was not adjusted. In one embodiment, the control circuit 200 generates a signal provided to the variable voltage supply 180 that causes the variable voltage supply 180 to decrease the peak-to-peak voltage to 700 volts for the cold zone, 600 volts for the temperate zone, and 500 volts for the hot zone. These peak-to-peak levels have been empirically determined as promoting electric field stabilization for the corresponding environmental conditions.

Figure 6:
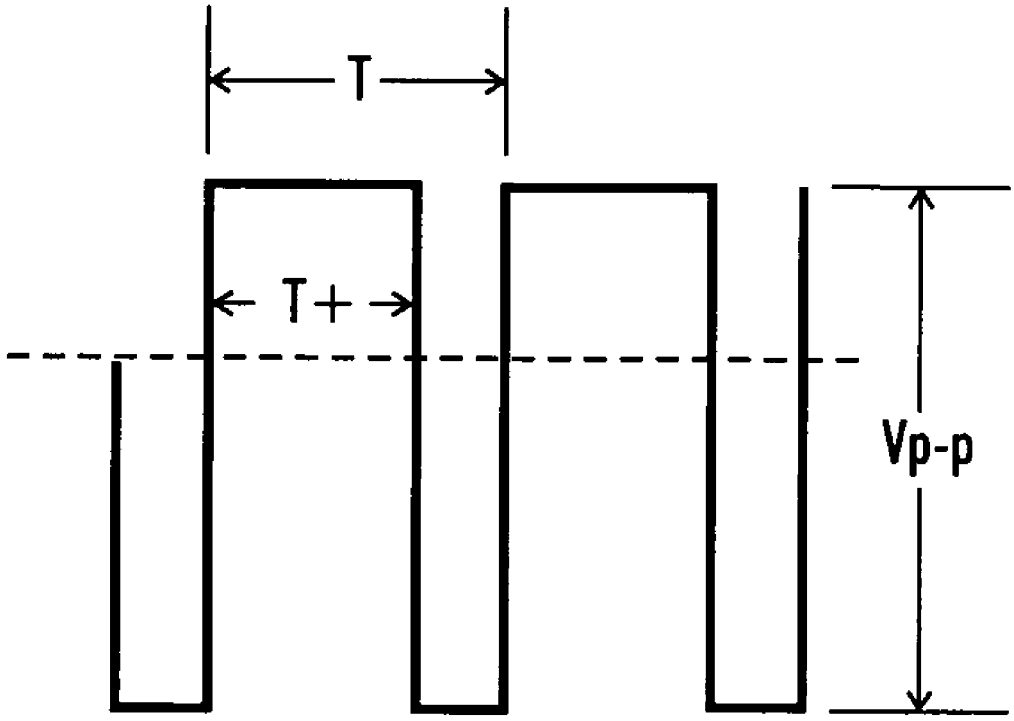
FIG. 6 is a diagram depicting parameters of an AC voltage generated by the variable voltage supply shown in FIG. 3.

In addition to the adjustments that may be made to the variable voltage supply 180 that have already been noted, the control circuit 200 may also adjust the duty cycle of the output voltage signal coupled to the magnetic rolls 36 and 38. As shown in FIG. 6, the frequency of the variable voltage supply output signal may be defined as 1/T where T is the length of time for one period of the output wave form. The duty cycle is defined as the ratio of the length of time that the waveform is positive during one period to the total length of time for one period of the waveform (T+/T). Another way in which the control circuit 200 enhances the stability of the electric fields at the surface of the photoreceptor 28 in the development gap between the magnetic rolls 36, 38 and the photoreceptor 28 is to maintain the duty cycle of the output waveform within a range that is above previously used ranges. Specifically, the control circuit 200 maintains the duty cycle of the output voltage in the range of approximately 65% to 75%. The control circuit 200 may perform this function using a pulse width modulated (PWM) circuit.

The control circuit 200 also maintains the frequency of the output voltage signal coupled to the magnetic rolls 36 and 38 above the frequency used in previously known development stations. Specifically, the control circuit 200 maintains the frequency of the output voltage in the range of approximately 12 KHz. The control circuit 200 performs the frequency monitoring and adjusting function using known frequency centering methods.

By implementing a control circuit 200 using the parameters discussed above and coupling the control circuit 200 to an environmental sensor 190, the variable voltage supply 180, and the pre-transfer corotron 202, a method of development station control may achieved. The method enables an environmental condition to be sensed, electric field fluctuation in the development gap between a magnetic roll 36 or 38 and the photoreceptor 28 to be reduced, and the development station sensitivity to electric field fluctuation to be reduced. The electric field fluctuation may be reduced by adjusting the peak-to-peak voltage Vp-p to correspond to the environmental conditions sensed by the environmental sensor 190. This adjustment may be a reduction in the peak-to-peak voltage Vp-p as the sensed relative humidity increases. The method implemented by the control circuit 200 may also maintain the cleaning field voltage in the range of about 120 to about 140 volts, operate a pre-transfer corotron 202 in a current range of about 17 μA to about 32 μA, and regulate the output frequency of the variable voltage supply 180 to 12 KHz. The method may also maintain the duty cycle of the output waveform for the variable voltage supply 180 in the range of about 65% to about 75%.

The embodiments described above have been discussed with regard to an arrangement for adjusting and regulating operation of a two magnetic roll development station in order to stabilize toner development over a wide range of environmental conditions. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A development station for an electrostatographic printing machine, comprising:

a developer housing, for retaining a quantity of developer having semi-conductive carrier particles and toner particles;

a first magnetic roll having a stationary core with at least one magnet and a sleeve having longitudinal grooves that rotates about the stationary core of the first magnetic roll to present developer on one side of the first magnetic roll to a photoreceptor;

a second magnetic roll having a stationary core with at least one magnet and a sleeve having longitudinal grooves that rotates about the stationary core of the second magnetic roll to receive developer from the first magnetic roll and present developer on one side of the second magnetic roll to the photoreceptor, the second magnetic roll being vertically displaced from the first magnetic roll so that a gap exists between the first and the second magnetic rolls;

an environmental sensor for generating an environmental condition signal;

a variable voltage supply coupled to the first magnetic roll and the second magnetic roll; and a control circuit for adjusting an output level for the variable voltage supply in response to the environmental condition signal.

2. The development station of claim 1 wherein the environmental condition signal indicates a continuous range of temperature.

3. The development station of claim 2, the environmental sensor further comprises:

a relative humidity sensor.

4. The development station of claim 3, the control circuit further comprises:

a reference voltage generator for generating a reference voltage signal that is coupled to the variable voltage supply; and the reference voltage generator decreasing the reference voltage signal in response to the environmental condition signal indicating an increase in relative humidity.

5. The development station of claim 2, the control circuit further comprises:

a pre-transfer signal generator for generating a pre-transfer signal to operate a pre-transfer corotron within a current range.

6. The development station of claim 5 wherein the pre-transfer signal operates the pre-transfer corotron in a current range of about 17 μA to about 32 μA.

7. The development station of claim 6 wherein the variable voltage supply generates an AC voltage having a frequency of approximately 12 KHz.

8. The development station of claim 7, the control circuit further comprising:

a duty cycle signal generator for generating a signal that maintains the AC voltage generated by the variable voltage supply at a duty cycle of approximately 70% approximately 5%.

9. The development station of claim 8, the control circuit further comprising:

a cleaning voltage reference signal generator for maintaining a cleaning field voltage in a range of about 120 volts to about 140 volts.

10. The development station of claim 5 wherein the control circuit further comprises:

a transfer signal generator for generating a transfer signal to operate a transfer corotron within a current range.

11. The development station of claim 10 wherein the transfer signal operates the transfer corotron in a current range of about 77 μA to about 88 μA.

12. An electrostatographic printing machine comprising:

a photoreceptor;

a raster output scanner (ROS) that generates a latent image on a portion of the photoreceptor as it moves past the ROS;

a development station for developing toner on the latent image;

a transfer station for transferring the developed toner to a substrate;

a fusing station for fixing the transferred toner to the substrate;

the development station further comprising:

a developer housing, for retaining a quantity of developer having semiconductive carrier particles and toner particles;

a first magnetic roll having a stationary core with at least one magnet and a sleeve having longitudinal grooves that rotates about the stationary core of the first magnetic roll to present developer on one side of the first magnetic roll to the photoreceptor;

a second magnetic roll having a stationary core with at least one magnet and a sleeve having longitudinal grooves that rotates about the stationary core of the second magnetic roll to receive developer from the first magnetic roll and present developer on one side of the second magnetic roll to the photoreceptor, the second magnetic roll being vertically displaced from the first magnetic roll so that a gap exists between the first and the second magnetic rolls;

an environmental sensor for generating an environmental condition signal;

a variable voltage supply coupled to the first magnetic roll and the second magnetic roll; and a control circuit for adjusting an output level for the variable voltage supply in response to the environmental condition signal.

13. The machine of claim 12, the control circuit further comprises:

a reference voltage generator for generating a reference voltage signal that is coupled to the variable voltage supply; and the reference voltage generator decreasing the reference voltage signal in response to the environmental condition signal indicating an increase in relative humidity.

14. The machine of claim 13 wherein the variable voltage supply generates an AC voltage having a frequency of approximately 12 KHz.

15. The machine of claim 14, the control circuit further comprising:

a duty cycle signal generator for generating a signal that maintains the AC voltage generated by the variable voltage supply at a duty cycle of approximately 70% ± approximately 5%.

16. The machine of claim 15, the control circuit further comprising:

a cleaning voltage reference signal generator for maintaining a cleaning field voltage in a range of about 120 volts to about 140 volts.

17. A method for controlling development of toner in an electrostatographic imaging machine comprising:

sensing an environmental condition;

reducing electric field fluctuation in a development gap between a magnetic roll in a development station and a photoreceptor;

reducing sensitivity of the development station to electric field fluctuation; and adjusting a peak-to-peak voltage coupled to the magnetic roll in the development station in response to the sensing of the environmental condition.

18. The method of claim 17, the peak-to-peak voltage adjustment further comprising:

reducing the peak-to-peak voltage in response to a sensed increase in relative humidity.

19. The method of claim 17, the reduction in the development station sensitivity to electric field fluctuations further comprising:

lowering a cleaning field voltage for the development station.

* * * * *